US008328518B2

(12) United States Patent
Liang et al.

(10) Patent No.: US 8,328,518 B2
(45) Date of Patent: Dec. 11, 2012

(54) TURBINE VANE FOR A GAS TURBINE ENGINE HAVING SERPENTINE COOLING CHANNELS

(75) Inventors: George Liang, Palm City, FL (US); Zhihong Gao, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 609 days.

(21) Appl. No.: 12/540,418

(22) Filed: Aug. 13, 2009

(65) Prior Publication Data

US 2011/0038709 A1 Feb. 17, 2011

(51) Int. Cl.
*F01D 5/08* (2006.01)

(52) U.S. Cl. ..... 416/96 R; 415/115; 416/97 R

(58) Field of Classification Search ..... 415/115; 416/96 R, 97 R

See application file for complete search history.

(56) References Cited

U.S. PATENT DOCUMENTS 4,930,980 A * 6/1990 North et al. ..... 415/115
5,120,192 A * 6/1992 Ohtomo et al. ..... 415/115
5,488,825 A * 2/1996 Davis et al. ..... 60/806
5,688,104 A * 11/1997 Beabout ..... 415/115
5,827,043 A * 10/1998 Fukuda et al. ..... 415/115
6,508,620 B2 * 1/2003 Sreekanth et al. ..... 415/115
6,902,372 B2 6/2005 Liang
6,932,573 B2 8/2005 Liang
6,981,846 B2 1/2006 Liang
7,090,461 B2 8/2006 Liang
7,118,337 B2 10/2006 Liang
7,137,779 B2 11/2006 Liang
7,137,780 B2 11/2006 Liang
7,189,060 B2 3/2007 Liang
7,217,097 B2 5/2007 Liang
7,281,895 B2 10/2007 Liang
7,296,972 B2 11/2007 Liang
7,303,376 B2 12/2007 Liang
7,390,168 B2 6/2008 Liang
7,413,407 B2 8/2008 Liang
7,435,053 B2 10/2008 Liang
7,458,778 B1 12/2008 Liang
7,473,073 B1 1/2009 Liang
7,481,622 B1 1/2009 Liang
7,481,623 B1 1/2009 Liang
7,520,725 B1 4/2009 Liang
7,527,474 B1 5/2009 Liang
7,527,475 B1 5/2009 Liang
7,530,789 B1 5/2009 Liang
7,534,089 B2 5/2009 Liang
7,537,431 B1 5/2009 Liang
7,967,567 B2 * 6/2011 Liang ..... 416/97 R

* cited by examiner

*Primary Examiner* — Igor Kershteyn

(57) ABSTRACT

A turbine vane for a gas turbine engine having an internal cooling system formed from at least one serpentine cooling channel with enhanced cooling elements. The serpentine cooling channel may include a first turn manifold with purge air discharge orifices inline with a first pass of the serpentine cooling channel. Cooling fluids may be used to cooling the leading edge of the vane and passed through the purge air discharge orifices to purge the rim cavity proximate to the endwall. The first turn manifold may also include a plurality of trip strips. The trips strips may be positioned on the suction and pressure sidewalls and may be offset from trip strips on the opposing sidewall. The cooling system may also include an aft purge rim orifice.

19 Claims, 5 Drawing Sheets

TURBINE VANE FOR A GAS TURBINE ENGINE HAVING SERPENTINE COOLING CHANNELS

FIELD OF THE INVENTION

This invention is directed generally to gas turbine engines, and more particularly to turbine vanes for gas turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are exposed to high temperature combustor gases that heat the airfoil. The airfoils include an internal cooling system for reducing the temperature of the airfoils. While there exist many configurations of cooling systems, there exists a need for improved cooling of gas turbine airfoils.

SUMMARY OF THE INVENTION

This invention is directed to a turbine vane for a gas turbine engine. The turbine vane may be configured to better accommodate high combustion gas temperatures than conventional vanes. In particular, the turbine vane may include an internal cooling system positioned within internal aspects of the vane. The internal cooling system may be formed from one or more serpentine cooling channels that may extend from an inner endwall (ID) to an outer endwall (OD) and from a leading edge to a trailing edge. The serpentine cooling channel may include a first turn manifold positioned at least partially in the inner endwall and may include one or more purge rim orifices for exhausting cooling fluids into a rim cavity for cooling. The first turn manifold may also include a plurality of trip strips on suction and pressure sidewalls to enhance the efficiency of the cooling system. The increased efficiency reduces the thermal degradation of the turbine vane.

The turbine vane may be formed from a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil. The internal cooling system may include at least one serpentine cooling channel that extends from proximate to the leading edge to proximate to the trailing edge. The serpentine cooling channel may include a first turn manifold in communication with a first pass and positioned at least partially in the first endwall at the first end and includes a plurality of trip strips protruding inwardly from an inner surface of a suction sidewall forming the suction side toward the pressure side and includes a plurality of trip strips protruding inwardly from an inner surface of a pressure sidewall forming the pressure side toward the suction side. The trip strips on the suction sidewall may be offset from the trip strips on the pressure sidewall. In at least one embodiment, the serpentine cooling channel may be a triple pass serpentine cooling channel. The trip strips may be positioned throughout first, second and third passes of the serpentine cooling channel.

The cooling system may also include a forward purge rim orifice in the first turn manifold at the suction sidewall and aligned with the first pass. The cooling system may also include a forward purge rim orifice in the first turn manifold at the pressure sidewall and aligned with the first pass. The forward purge rim orifices enable cooling fluids that have been used to cool the leading edge of the airfoil to also be used to purge the rim cavity.

The cooling system may include one or more trailing edge exhaust orifices in communication with the a serpentine cooling channel. The trailing edge exhaust orifices may also include one or more aft purge rim orifices proximate to an intersection of the trailing edge and the first endwall and proximate to the trailing edge exhaust orifices. The aft purge rim orifices may be positioned to provide cooling fluids to the rim cavities.

During use, cooling fluids are supplied from a compressor or other such source to the first pass at the outer endwall. Cooling fluids may be passed along the leading edge to cool the material forming the leading edge. A portion of the cooling fluids may be exhausted from the first pass through one or more forward purge rim orifices. The cooling fluids flowing out of the forward purge rim orifices accomplish two purposes. In particular, those cooling fluids cool the leading edge and purge the rim cavity. The remaining cooling fluids flow into the first turn manifold where the cooling fluids encounter the offset trip strips. The offset trip strips on the suction and pressure sidewalls cause turbulence in the cooling fluids that increase the heat transfer versus conventional configurations. The pressure side walls increase skin friction coefficient for the turn side walls thereby eliminating flow separation within the manifold. The cooling fluids are then passed through the second and third passes where the cooling fluids cool aspects of the turbine vane in the midchord region. The cooling fluids may be exhausted through the trailing edge exhaust orifices positioned along the trailing edge. A portion of the cooling fluids may also be exhausted through the aft purge rim orifices.

An advantage of the internal cooling system is that a portion of the cooling fluids flowing through the first pass of the cooling system also flow through the forward purge rim orifices and thereby are used for two cooling purposes, which improves efficiency.

Another advantage of the internal cooling system is that the leading edge of the turbine vane is cooled with the entire flow of cooling fluids into the turbine vane, which maximizes the use of the cooling fluids at the highest heat load region of the vane and minimizes the over heating of cooling air delivery to the inter-stage housing.

Yet another advantage of the internal cooling system is that the forward purge rim orifices are positioned such that cooling fluids that pass through the orifices do so before the cooling fluids reach the first turn manifold and undergo a pressure reduction. Exhausting the cooling fluids through the forward purge rim orifices before the first turn manifold also minimizes rapid changing of the internal flow Mach number in the first turn manifold.

Another advantage of the internal cooling system is that the aft purge rim orifice not only exhausts cooling fluids during use of the turbine vane in a turbine engine but also can function as a conduit through which additional support for the ceramic core used to form the serpentine cooling channel may be inserted during casting.

Still another advantage of the internal cooling system is that use of the overlapping trip strips in the serpentine cooling channel yields higher heat transfer at the airfoil leading edge with the curved trip strips than conventional configurations and minimizes overheating of the purge cooling air.

Another advantage of the internal cooling system is that the offset trip strips in the first turn manifold increase the side wall surface skin friction coefficient, which eliminates the internal flow separation within the first turn manifold.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
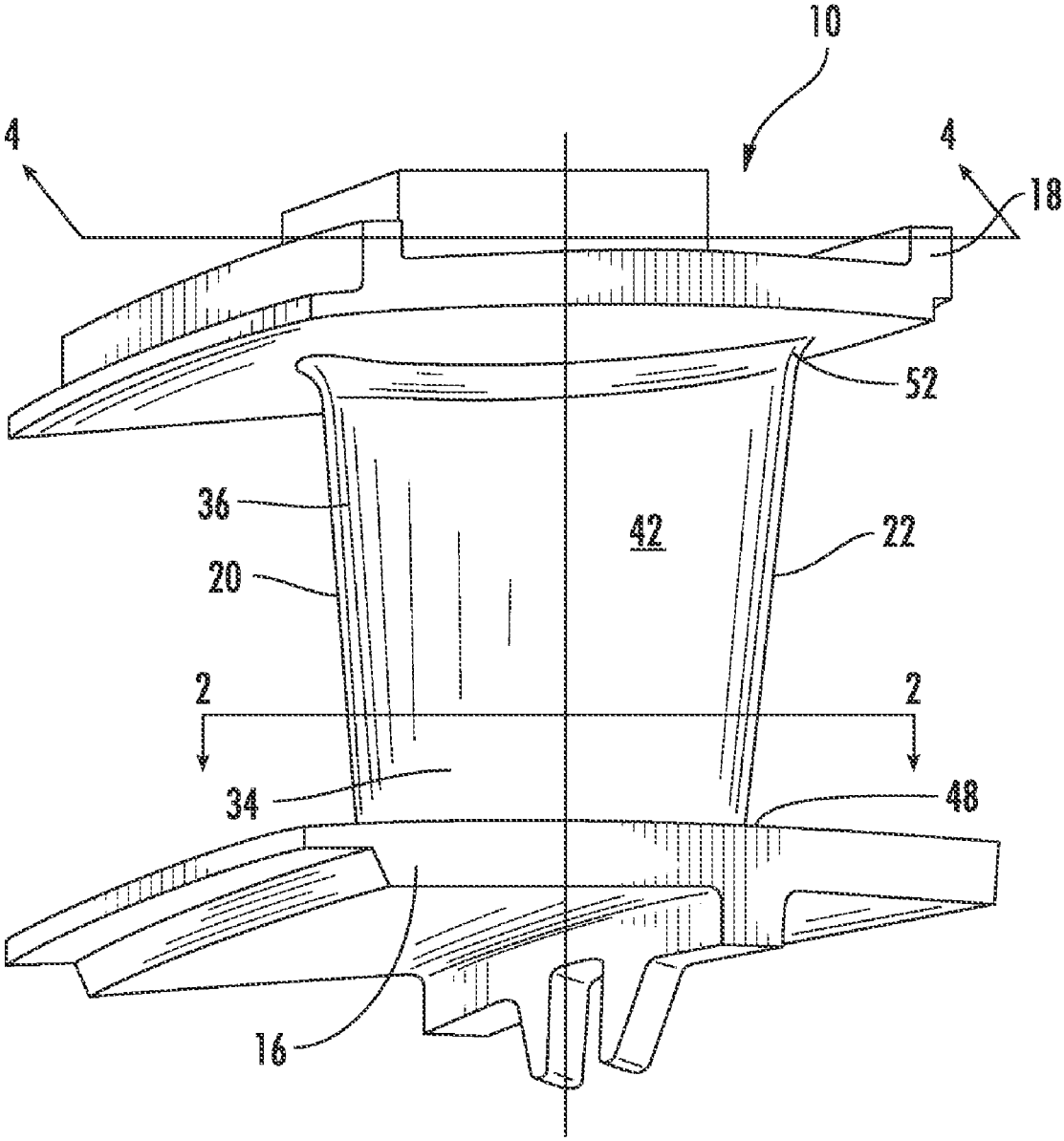
FIG. 1 is a perspective view of a turbine vane with aspects of this invention.

As shown in FIGS. 1-7, this invention is directed to a turbine vane 10 for a gas turbine engine. The turbine vane 10 may be configured to better accommodate high combustion gas temperatures than conventional vanes. In particular, the turbine vane 10 may include an internal cooling system 12 positioned within internal aspects of the vane 10. The internal cooling system 12 may be formed from one or more serpentine cooling channels 14 that may extend from an inner endwall 16 (ID) to an outer endwall 18 (OD) and from a leading edge 20 to a trailing edge 22. The serpentine cooling channel 14 may include a first turn manifold 24 positioned at least partially in the inner endwall 16 and may include one or more purge rim orifices 26 for exhausting cooling fluids into a rim cavity for cooling. The first turn manifold 24 may also include a plurality of trip strips 28 on suction and pressure sidewalls 30, 32 to enhance the efficiency of the cooling system. The increased efficiency reduces the thermal degradation of the turbine vane 10.

The turbine vane 10 may have any appropriate configuration and, in at least one embodiment, may be formed from a generally elongated airfoil 34 formed from an outer wall 36, and having the leading edge 20, the trailing edge 22, a pressure side 42, a suction side 44 generally opposite to the pressure side 42, a first endwall 16, which is also referred to as the inner endwall, at a first end 48, a second endwall 18, which is also referred to as the outer endwall, at a second end 52 opposite the first end 48, and an internal cooling system 12 positioned within the generally elongated airfoil 34.

The internal cooling system 12 may include one or more serpentine cooling channels 14 that extend from proximate to the leading edge 20 to proximate to the trailing edge 22. The serpentine cooling channel 14 may include a first turn manifold 24 in communication with a first pass 54. The serpentine cooling channel 14 may be positioned at least partially in the first endwall 16 at the first end 48 and may include a plurality of trip strips 28 protruding inwardly from an inner surface 56 of a suction sidewall 30 forming the suction side 44 toward the pressure side 42.

Figure 4:
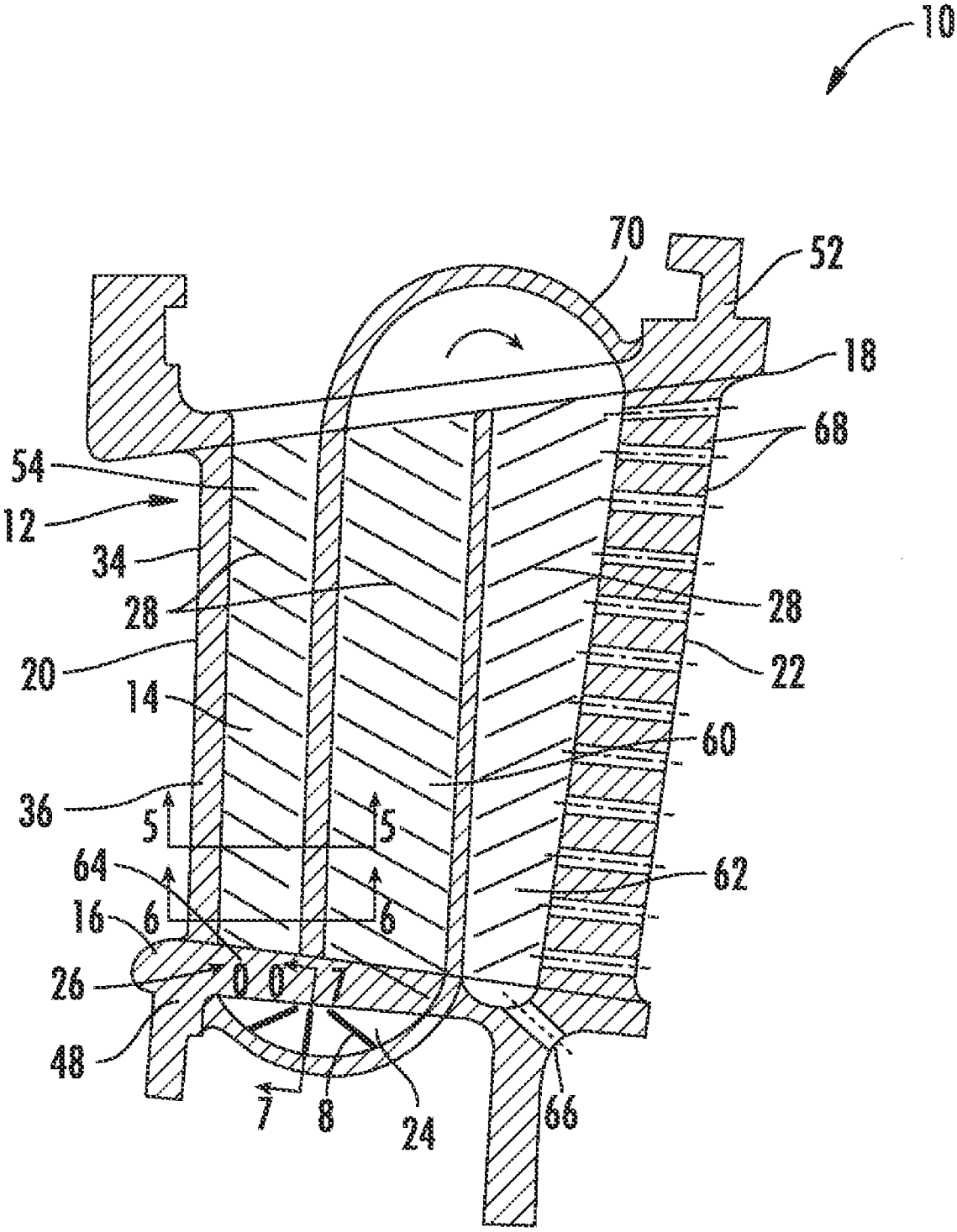
FIG. 4 is cross-sectional view, which is also referred to as a filleted view, of the turbine vane along section line 4-4 in FIG. 1.
Figure 5:
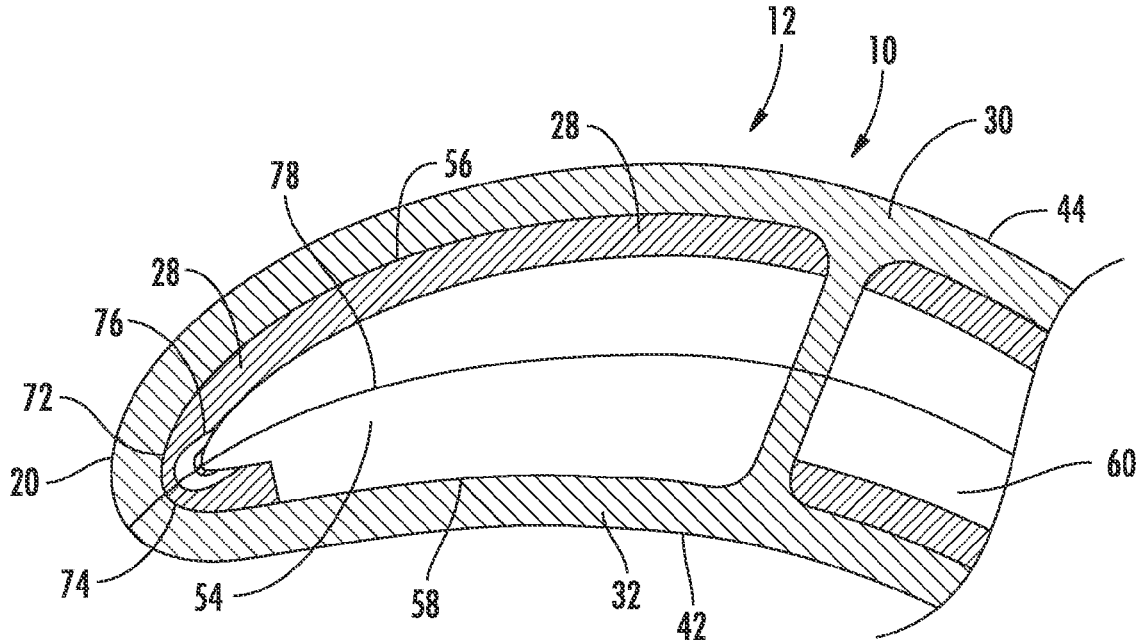
FIG. 5 is a partial cross-sectional view of the first turn manifold taken along section line 5-5 in FIG. 4 displaying a suction side trip strip.
Figure 7:
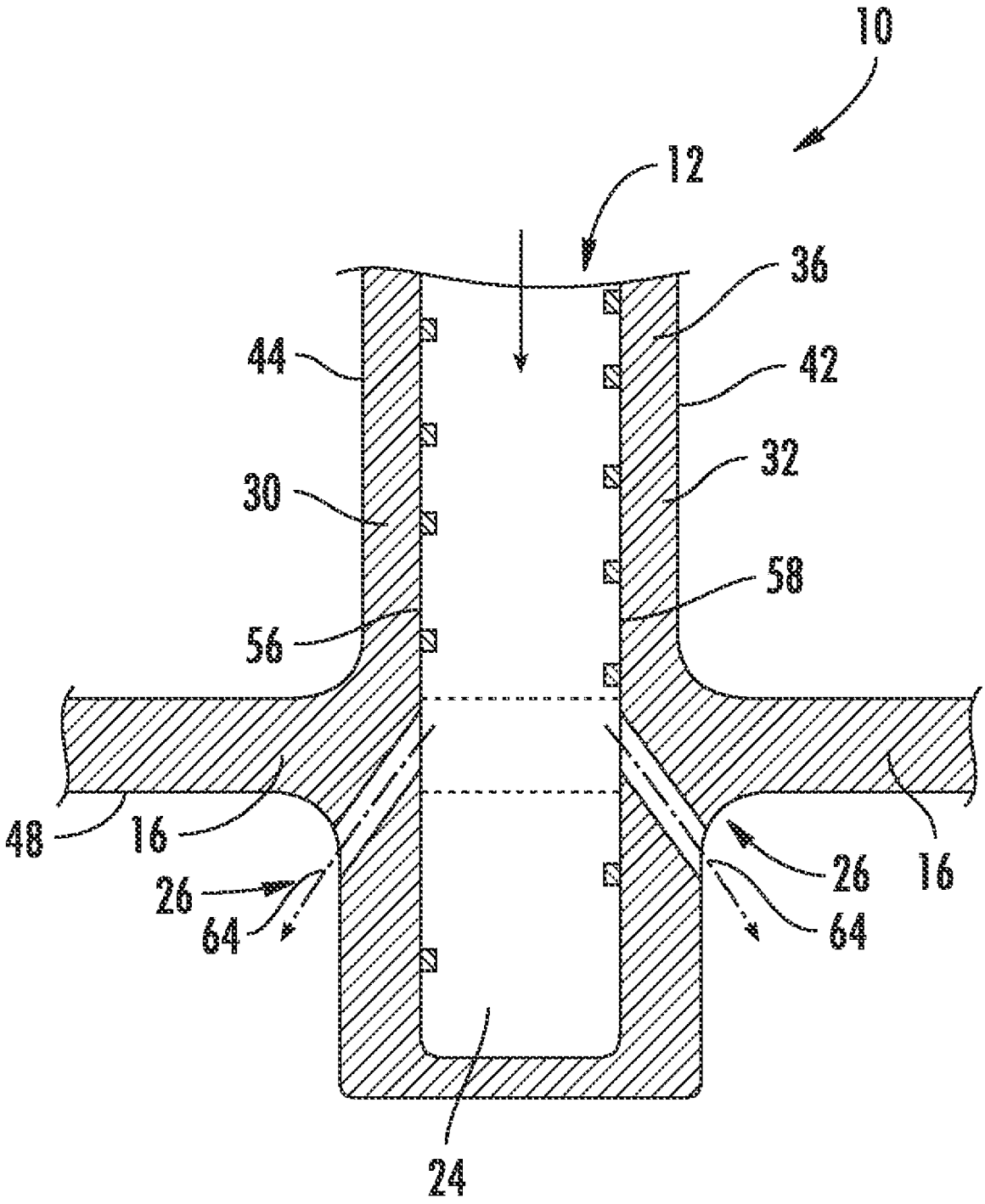
FIG. 7 is a partial a cross-sectional view of the first turn manifold taken along section line 7-7 in FIG. 4 displaying the suction side and pressure side trip strips.

The serpentine cooling channel 14 may include a plurality of trip strips 28 protruding inwardly from an inner surface 58 of a pressure sidewall 32 forming the pressure side 42 toward the suction side 44. As shown in FIG. 7, the trip strips 28 on the suction sidewall 30 may be offset from the trip strips 28 on the pressure sidewall 32. Offsetting the trip strips 28 may increase the cooling efficiency of the cooling system 12 by yielding a higher heat transfer enhancement for the serpentine flow channel 14 and minimize cooling flow separation within the first turn manifold 24. As shown in FIGS. 4 and 5, the trip strips 28 may be configured to be positioned on the suction side 44 and an inner surface of the leading edge 20. The trip strips 28 may be configured to be positioned on the pressure side 42 and an inner surface 72 of the leading edge 20. Thus, the trip strips 28 are curved about the inner surface 72 forming the leading edge 20.

Figure 2:
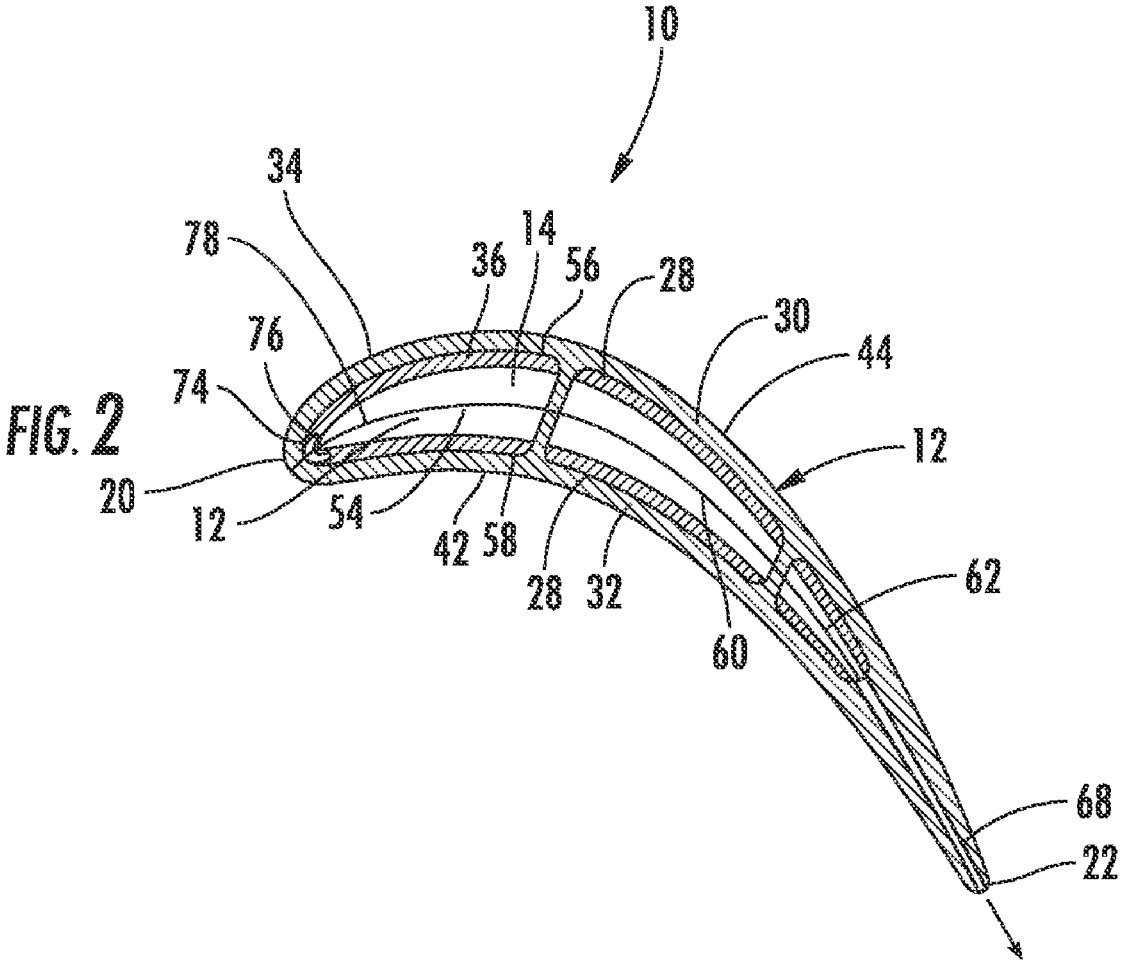
FIG. 2 is a cross-sectional view of the turbine vane taken at section line 2-2 in FIG. 1.
Figure 3:
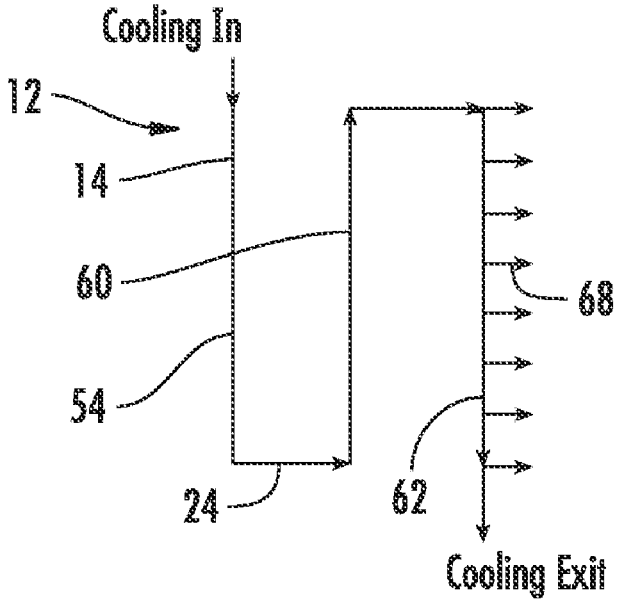
FIG. 3 is a schematic diagram of the cooling fluid flow through the turbine vane.
Figure 6:
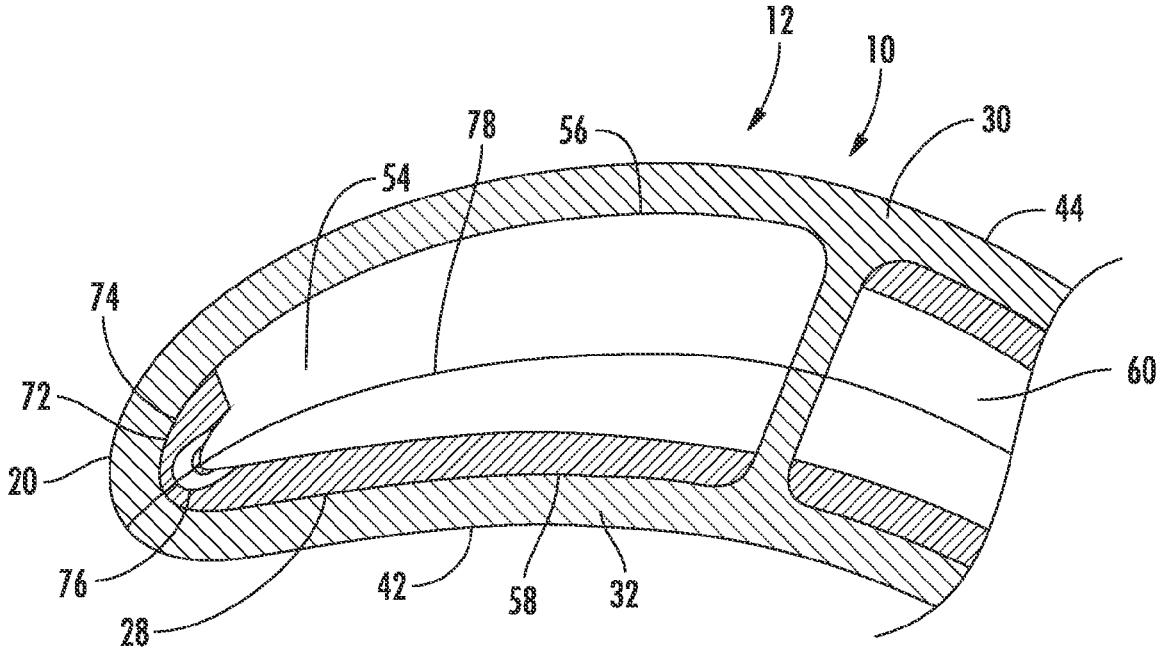
FIG. 6 is a partial cross-sectional view of the first turn manifold taken along section line 6-6 in FIG. 4 displaying a pressure side trip strip.

In at least one embodiment, as shown in FIGS. 2, 5, 6, the trip strip 28 in the airfoil leading edge corner 74 may include a small notch 76. The notch 76 may be cut out of the trip strip 28 at the parting line 80. The notch 76 may improve casting yields and enhance the heat transfer augmentation due to a small amount of cooling air flow through the open notch 76. This airflow initiates a new boundary layer at the inner surface of the leading edge 20 that create a higher heat transfer coefficient for the airfoil leading edge 20 inner surface. The notch 76 may include any appropriate configuration. In at least one embodiment, the notch 76 may be generally U-shaped.

The trip strips 28, as shown in FIG. 4, may be skewed relative to the direction of flow of the cooling fluids. Skewing the trip strips 28 increases the effectiveness of the trip strips 28 by creating vortices at the trip strips 28 that travel the length of the trip strips 28 and are then disrupted at the end of the trip strips 28. The trip strips 28 may have a double radius cross-sectional area or may have any other appropriate shape. The trip strips 28 may also be positioned such that the trip strips 28 are overlapping, which refers to the fact that when skewed, more than one trip strip 28 intersects with a line extending orthogonal to the direction of flow of cooling fluids through the serpentine cooling channel 14. The trip strips 28 may extend toward an opposing sidewall any appropriate distance into the flow of cooling fluids. As shown in FIG. 4, the serpentine cooling channel 14 may be a triple pass serpentine cooling channel. The trips strips 28 may be positioned throughout first, second and third passes 54, 60, 62 of the serpentine cooling channel 14. The second and third passes 60, 62 may be coupled together with a second turn manifold 70. In at least one embodiment, the second turn manifold 70 may be positioned at least partially in the outer endwall 18. The manifold 70 may include smooth sidewalls without trip strips.

The cooling system 12 may also include one or more purge rim orifices 26 for providing cooling fluids to the rim cavity. In particular, the cooling system 12 may include a forward purge rim orifice 64 in the first turn manifold 24 at the suction sidewall 30 and aligned with the first pass 54. As shown in FIG. 7, the forward purge rim orifice 64 may be positioned at an intersection between the suction sidewall 30 and the inner endwall 16. Alternatively or in addition to the purge rim orifice 64 on the suction sidewall 30, a forward purge rim orifice 64 may be positioned at an intersection between the pressure sidewall 32 and the inner endwall 16. The forward purge rim orifice 64 may be positioned nonparallel and non-orthogonal to the inner surface 56, 58 of the suction and pressure sidewalls 30, 32. The forward purge rim orifices 64 may be aligned with the first pass 54, as shown in FIG. 4. By aligning the forward purge rim orifices 64 with the first pass 54, the cooling fluids may cooling the leading edge 20 and a portion of those cooling fluids be exhausted through the forward purge rim orifices 64 before suffering any energy loss due to turning in the first turn manifold 24.

As shown in FIG. 4, the cooling system may include one or more trailing edge exhaust orifices 68 in communication with the serpentine cooling channel 14. The trailing edge exhaust orifices 68 may be sized and configured such that cooling fluids from the third pass 62 and be exhausted out of the trailing edge 22. The cooling system 12 may also include one or more aft purge rim orifices 66 proximate to an intersection of the trailing edge 22 and the first endwall 16. The aft purge rim orifices 66 may have any appropriate configuration to cool rim cavities.

During use, cooling fluids are supplied from a compressor or other such source to the first pass 54 at the outer endwall 18. Cooling fluids may be passed along the leading edge 20 to cool the material forming the leading edge 20. A portion of the cooling fluids may be exhausted from the first pass 54 through one or more forward purge rim orifices 64. The cooling fluids flowing out of the forward purge rim orifices 64 accomplish two purposes. In particular, those cooling fluids cool the leading edge and purge the rim cavity. The remaining cooling fluids flow into the first turn manifold 24 where the cooling fluids encounter the offset trip strips 28. The offset trip strips 28 on the suction and pressure sidewalls 30, 32, as shown in FIGS. 4-6, cause turbulence in the cooling fluids that increase the heat transfer versus conventional configurations and increase the skin friction coefficient in the first turn manifold 24, thereby eliminating flow separation within the manifold 24. The cooling fluids are then passed through the second and third passes 60, 62 where the cooling fluids cool aspects of the turbine vane 10 in the midchord region. The cooling fluids may be exhausted through the trailing edge exhaust orifices 68 positioned along the trailing edge 22. A portion of the cooling fluids may also be exhausted through the aft purge rim orifices 66.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine vane for a gas turbine engine, comprising:

a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil;

wherein the internal cooling system includes at least one serpentine cooling channel that extends from proximate to the leading edge to proximate to the trailing edge;

wherein the at least one serpentine cooling channel includes a first turn manifold in communication with a first pass and positioned at least partially in the first endwall at the first end and includes a plurality of trip strips protruding inwardly from an inner surface of a suction sidewall forming the suction side toward the pressure side and includes a plurality of trip strips protruding inwardly from an inner surface of a pressure sidewall forming the pressure side toward the suction side;

wherein the trip strips on the suction sidewall are offset from the trip strips on the pressure sidewall.

2. The turbine vane of claim 1, wherein the at least one serpentine cooling channel is a triple pass serpentine cooling channel.

3. The turbine vane of claim 1, wherein the trips strips are positioned in the first pass of the at least one serpentine cooling channel and the trip strips in the first pass are curved about an inner surface forming the leading edge.

4. The turbine vane of claim 3, further comprising a notch positioned at a parting line in at least one trip strip at the airfoil leading edge corner.

5. The turbine vane of claim 1, wherein the trips strips are positioned throughout first, second and third passes of the at least one serpentine cooling channel.

6. The turbine vane of claim 1, further comprising at least one trailing edge exhaust orifice in communication with the at least one serpentine cooling channel.

7. The turbine vane of claim 1, further comprising at least one forward purge rim orifice in the first turn manifold at the suction sidewall and aligned with the first pass.

8. The turbine vane of claim 7, further comprising at least one forward purge rim orifice in the first turn manifold at the pressure sidewall and aligned with the first pass.

9. The turbine vane of claim 8, further comprising at least one aft purge rim orifice proximate to an intersection of the trailing edge and the first endwall.

10. The turbine vane of claim 1, further comprising at least one forward purge rim orifice in the first turn manifold at the pressure sidewall and aligned with the first pass.

11. A turbine vane for a gas turbine engine, comprising:

a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil;

wherein the internal cooling system includes at least one serpentine cooling channel that extends from proximate to the leading edge to proximate to the trailing edge;

wherein the at least one serpentine cooling channel includes a first turn manifold in communication with a first pass and positioned at least partially in the first endwall at the first end;

at least one forward purge rim orifice in the first turn manifold that is aligned with the first pass; and wherein further comprising a plurality of trip strips protruding inwardly from an inner surface of a suction sidewall forming the suction side toward the pressure side and includes a plurality of trip strips protruding inwardly from an inner surface of a pressure sidewall forming the pressure side toward the suction side and wherein the trip strips on the suction sidewall are offset from the trip strips on the pressure sidewall.

12. The turbine vane of claim 11, wherein the trips strips are positioned throughout first, second and third passes of the at least one serpentine cooling channel and the trip strips in the first pass are curved about an inner surface forming the leading edge.

13. The turbine vane of claim 12, further comprising a notch positioned at a parting line in at least one trip strip at a airfoil leading edge corner.

14. The turbine vane of claim 11, wherein the at least one serpentine cooling channel is a triple pass serpentine cooling channel.

15. The turbine vane of claim 11, further comprising at least one trailing edge exhaust orifice in communication with the at least one serpentine cooling channel and wherein the at least one forward purge rim orifice in the first turn manifold is positioned in a suction sidewall.

16. The turbine vane of claim 11, wherein the at least one forward purge rim orifice in the first turn manifold includes at least one forward purge rim orifice positioned in a pressure sidewall.

17. The turbine vane of claim 11, wherein the at least one forward purge rim orifice in the first turn manifold is positioned in a pressure sidewall and further comprising at least one aft purge rim orifice proximate to an intersection of the trailing edge and the first endwall.

18. A turbine vane for a gas turbine engine, comprising:

a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil;

wherein the internal cooling system includes at least one serpentine cooling channel that extends from proximate to the leading edge to proximate to the trailing edge;

wherein the at least one serpentine cooling channel includes a first turn manifold in communication with a first pass and positioned at least partially in the first endwall at the first end and includes a plurality of trip strips protruding inwardly from an inner surface of a suction sidewall forming the suction side toward the pressure side and includes a plurality of trip strips protruding inwardly from an inner surface of a pressure sidewall forming the pressure side toward the suction side;

wherein the trip strips on the suction sidewall are offset from the trip strips on the pressure sidewall in the first turn manifold;

at least one forward purge rim orifice in the first turn manifold at the suction sidewall and aligned with the first pass;

at least one forward purge rim orifice in the first turn manifold at the pressure sidewall and aligned with the first pass;

at least one aft purge rim orifice proximate to an intersection of the trailing edge and the first endwall; and at least one trailing edge exhaust orifice in communication with the at least one serpentine cooling channel.

19. The turbine vane of claim 18, wherein the at least one serpentine cooling channel is a triple pass serpentine cooling channel, wherein the trips strips are positioned throughout first, second and third passes of the at least one serpentine cooling channel in addition to being positioned in the first turn manifold, and the trip strips in the first pass are curved about an inner surface forming the leading edge and include a notch positioned at a parting line in at least one trip strip at the airfoil leading edge corner.

* * * * *